US009093757B2

(12) United States Patent
Aoki et al.

(10) Patent No.: US 9,093,757 B2
(45) Date of Patent: Jul. 28, 2015

(54) ANTENNA

(75) Inventors: Yutaka Aoki, Ome (JP); Akira Saitou, Machida (JP); Kazuhiko Honjo, Tsukuba (JP)

(73) Assignees: CASIO COMPUTER CO., LTD., Tokyo (JP); THE UNIVERSITY OF ELECTRO-COMMUNICATIONS, Tokyo (JP)

( * ) Notice: Subject to any disclaimer, the term of this patent is extended or adjusted under 35 U.S.C. 154(b) by 358 days.

(21) Appl. No.: 13/819,711

(22) PCT Filed: Aug. 30, 2011

(86) PCT No.: PCT/JP2011/069623

§ 371 (c)(1),
(2), (4) Date: Feb. 27, 2013

(87) PCT Pub. No.: WO2012/029793

PCT Pub. Date: Mar. 8, 2012

(65) Prior Publication Data

US 2013/0169506 A1 Jul. 4, 2013

(51) Int. Cl.

| | |
|---|---|
| ***H01Q 21/26*** | (2006.01) |
| ***H01Q 21/06*** | (2006.01) |
| ***H01Q 21/24*** | (2006.01) |
| ***H01Q 9/28*** | (2006.01) |

(Continued)

(52) U.S. Cl.

CPC ..... *H01Q 21/06* (2013.01); *H01Q 5/321* (2015.01); *H01Q 9/285* (2013.01); *H01Q 21/0006* (2013.01); *H01Q 21/24* (2013.01); *H01Q 21/26* (2013.01)

(58) Field of Classification Search

CPC ..... H01Q 21/26; H01Q 21/24

See application file for complete search history.

(56) References Cited

U.S. PATENT DOCUMENTS

| | | | |
|---|---|---|---|
| 2,521,550 | A | 9/1950 | Smith |
| 7,385,399 | B2 | 6/2008 | Deimling et al. |

(Continued)

FOREIGN PATENT DOCUMENTS

| | | | |
|---|---|---|---|
| CN | 101029921 | A | 9/2007 |
| CN | 101436715 | A | 5/2009 |

(Continued)

OTHER PUBLICATIONS

International Search Report (ISR) dated Oct. 25, 2011 (and English translation thereof) issued in parent International Application No. PCT/JP2011/069623.

(Continued)

*Primary Examiner* — Graham Smith

(74) *Attorney, Agent, or Firm* — Holtz, Holtz, Goodman & Chick PC

(57) ABSTRACT

A multi-frequency circularly polarized antenna (100) comprises a substrate and multi-frequency antennas (900, 901). The multi-frequency antennas (900, 901) comprise antenna elements (120, 220, 30, 420), shunt-inductor conductors (170, 270, 370, 470), series-capacitor conductors (160*a*, 160*b*, 260*a*, 260*b*, 360*a*, 360*b*, 460*a*, 460*b*), series-inductor capacitors (140, 240, 340, 440), a center point (199) and input/output terminals (1*q*0, 210, 310, 410). The multi-frequency circularly polarized antenna (100) is constructed by connecting the shunt-inductor conductors (170, 270, 370, 470) of the multi-frequency antennas (900, 901) at the center point (199) in a substantially perpendicular manner.

6 Claims, 18 Drawing Sheets

(51) Int. Cl.
*H01Q 21/00* (2006.01)
*H01Q 5/321* (2015.01)

(56) References Cited

U.S. PATENT DOCUMENTS

2004/0140941 A1 7/2004 Joy et al.
2012/0218162 A1 8/2012 Aoki et al.

FOREIGN PATENT DOCUMENTS

JP 11-023692 A 1/1999
JP 2004-242277 A 8/2004
JP 2009-010471 A 1/2009
JP 2009-044207 A 2/2009
JP 2011-176495 A 9/2011

OTHER PUBLICATIONS

Akira Saitou, et al.; "Basic study on improvement of pattern orthogonality for dual-band MIMO antennas": The Institute of Electronics, Information and Communication Engineers: IEICE Technical Report (Sep. 2009): pp. 13-18 (and English Abstract thereof).

Chinese Office Action dated Mar. 27, 2014 in counterpart Chinese Application No. 201180041954.1.

ANTENNA

TECHNICAL FIELD

The present invention relates to a compact, multi-resonant frequency circularly polarized antenna.

BACKGROUND ART

Various wireless systems are becoming popular, including car navigation systems and mobile handsets equipped with GPS (Global Positioning System). With the spread of ETC (Electronic Toll Collection) systems, development of a vehicular antenna that can cope with circularly polarized waves of multiple frequencies from GPS and ETC systems is being sought for car navigation systems. Furthermore, development of compact, circularly polarized antennas that can be housed not just in a car navigation system but also in a small mobile handset casing, such as a cell phone, digital camera, PDA, wristwatch and/or the like, is being sought.

With regard to compact circularly polarized antennas, a patch antenna that uses ceramics with high dielectric constants is widely used.

However, a patch antenna using ceramics with high dielectric constants is heavy, making construction onerous and thinness difficult to achieve.

A compact multi-frequency antenna with large benefits, with which compactness and light weight are possible with multiple frequencies, is disclosed in Non-Patent Literature 1.

However, this antenna is linearly polarized and is not compatible with circularly polarized waves.

PRIOR ART LITERATURE

Non-Patent Literature

Non-Patent Literature 1: Akira SAITOU, Yuuya HOSHINO, Yutaka AOKI, and Kazuhiko HONJO, "Basic study on improvement of pattern orthogonality for dual-band MIMO antennas", The Institute of Electronics, Information and Communication Engineers, IEICE Technical Report (2009-09)

DISCLOSURE OF THE INVENTION

Problem to be Solved by the Invention

An antenna using ceramics with high dielectric constants is heavy compared to antennas formed by patterning on a printed circuit board, making manufacturing methods complex and expensive and also making thinness difficult to achieve.

It is an objective of the present invention to provide a compact, multi-frequency circularly polarized antenna.

Means for Solving the Problem

In order to achieve the above objective, an antenna according to the present invention is an antenna comprising first and second multi-frequency antennas, each comprising:

a first antenna with multiple resonant frequencies, comprising a first input/output terminal, a first antenna conductor, a series circuit of a first inductor and a first capacitor connecting the first input/output terminal and the first antenna conductor, and a second inductor one end of which is connected to the first antenna conductor;

a second antenna with multiple resonant frequencies, comprising a second input/output terminal, a second antenna conductor, a series circuit of a third inductor and a second capacitor connecting the second input/output terminal and the second antenna conductor, and a fourth inductor one end of which is connected to the second antenna conductor and the other end of which is connected to the other end of the second inductor; and wherein the first antenna and the second antenna are positioned substantially mirror-image symmetrically;

wherein the first multi-frequency antenna and the second multi-frequency antenna are positioned so as to intersect substantially orthogonally at a center point, and the other end of the fourth inductor of the first multi-frequency antenna is further connected to the other end of the fourth inductor of the second multi-frequency antenna.

For example, the multiple resonant frequencies of the first antenna and the multiple resonant frequencies of the second antenna are substantially the same.

In addition, the antenna may further comprise a dielectric board;

wherein the first and second input/output terminals and the first and second antenna conductors are formed on one surface of the dielectric board;

the second and fourth inductors are disposed on the other surface of the dielectric board, and through a via one end of the second inductor is connected to the first antenna conductor and one end of the fourth inductor is connected to the second antenna conductor;

the first capacitor comprises a portion of the first antenna conductor, a first conductor disposed on the other surface of the dielectric board and opposing the portion of the first antenna conductor, and the dielectric board positioned between the portion of the first antenna conductor and the first conductor;

the second capacitor comprises a portion of the second antenna conductor, a second conductor disposed on the other surface of the dielectric board and opposing the portion of the second antenna conductor, and the dielectric board positioned between the portion of the second antenna conductor and the second conductor;

the first inductor is disposed on one surface of the dielectric board, one end of the first inductor is connected to the first conductor through a via and the other end of the first inductor is connected to the first input/output terminal; and the third inductor is disposed on one surface of the dielectric board, one end of the third inductor is connected to the second conductor through a via and the other end of the third inductor is connected to the second input/output terminal.

In addition, the antenna my further comprise:

a first signal source one end of which is connected to the first input/output terminal of the first multi-frequency antenna and the other end of which is connected to the second input/output terminal of the first multi-frequency antenna; and a second signal source one end of which is connected to the first input/output terminal of the second multi-frequency antenna and the other end of which is connected to the second input/output terminal of the second multi-frequency antenna;

wherein the signal generated by the first signal source and the signal generated by the second signal source have the same amplitude and have a phase difference of $\pm\pi/2$.

In addition, the antenna may be such that:

the first input/output terminal of the first multi-frequency antenna and the first input/output terminal of the second multi-frequency antenna are connected and form one input/output terminal, and the second input/output terminal of the first multi-frequency antenna and the second input/output terminal of the second multi-frequency antenna are connected and form one input/output terminal;

the antenna further comprises a signal source one end of which is connected to the first input/output terminal of the first multi-frequency antenna and the other end of which is connected to the second input/output terminal of the second multi-frequency antenna; and the inductance of the first through fourth inductors and the capacitance of the first and second capacitors are adjusted so that radio waves emitted from the first multi-frequency antenna and radio waves emitted from the second multi-frequency antenna have the same amplitude and the phase difference becomes $\pm\pi/2$.

For example, the antenna may further comprise:

a first switching element one end of which is connected to the first input/output terminal of the first multi-frequency antenna and the other end of which is connected to the first input/output terminal of the second multi-frequency antenna;

a second switching element one end of which is connected to the first input/output terminal of the first multi-frequency antenna and the other end of which is connected to the second input/output terminal of the second multi-frequency antenna;

a third switching element one end of which is connected to the second input/output terminal of the first multi-frequency antenna and the other end of which is connected to the first input/output terminal of the second multi-frequency antenna;

a fourth switching element one end of which is connected to the second input/output terminal of the first multi-frequency antenna and the other end of which is connected to the second input/output terminal of the second multi-frequency antenna; and a signal source one end of which is connected to the first input/output terminal of the first multi-frequency antenna and the other end of which is connected to the second input/output terminal of the first multi-frequency antenna;

wherein when the first and fourth switching elements are on, the second and third switching elements are off, and when the first and fourth switching elements are off, the second and third switching elements are on; and the inductance of the first through fourth inductors and the capacitance of the first and second capacitors are adjusted so that radio waves emitted from the first multi-frequency antenna and radio waves emitted from the second multi-frequency antenna have the same amplitude and the phase difference becomes $\pm\pi/2$.

Effects of the Invention

With the present invention, it is possible to provide a compact, multi-frequency circularly polarized antenna.

MODE FOR CARRYING OUT THE INVENTION

First Preferred Embodiment

Figure 1:
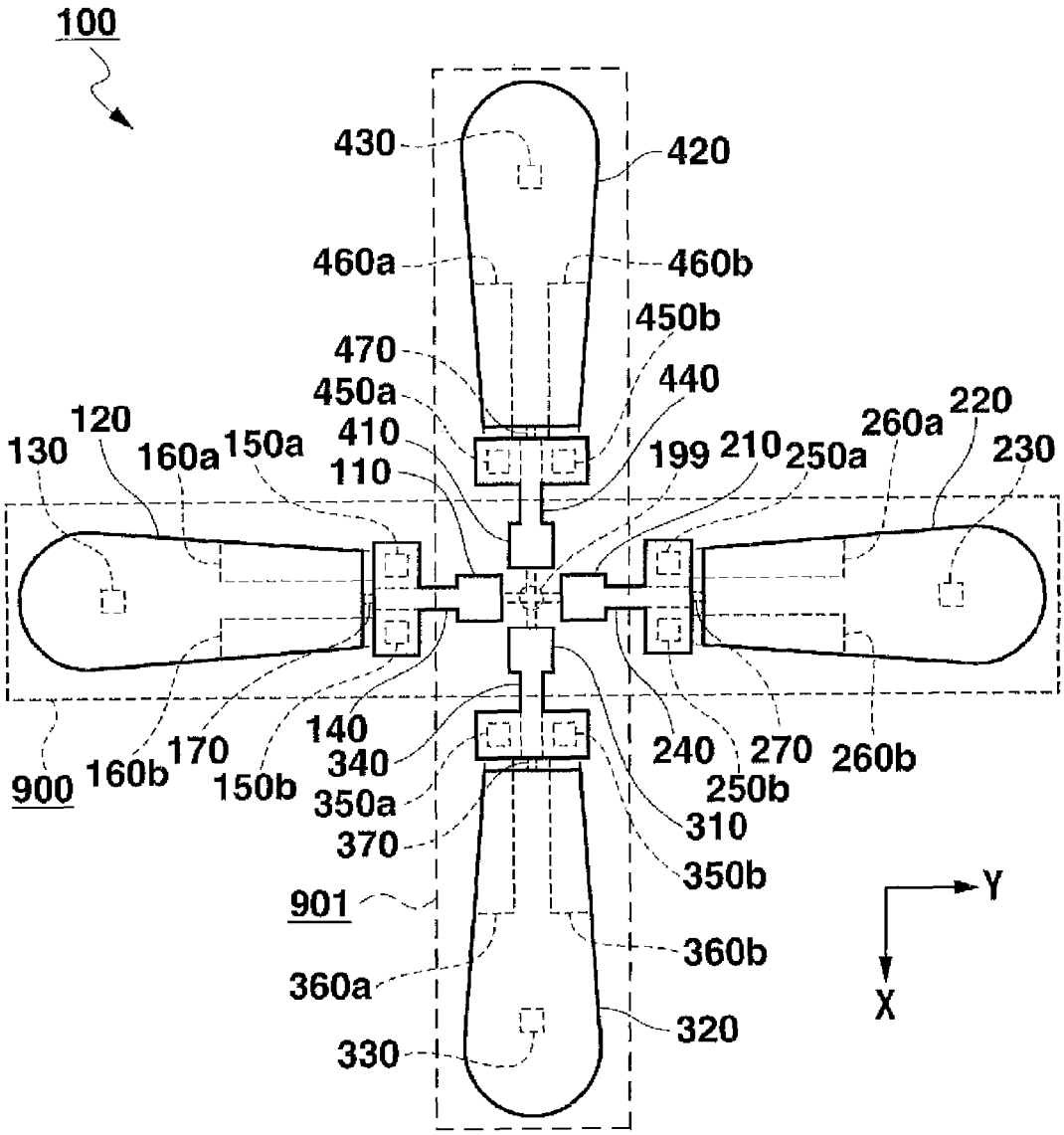
FIG. 1 is a planar view of a multi-frequency circularly polarized antenna according to a first preferred embodiment of the present invention.

Below, a multi-frequency circularly polarized antenna 100 according to a first preferred embodiment of the present invention is described.

The composition of the multi-frequency circularly polarized antenna 100 according to the first preferred embodiment is described with reference to FIGS. 1-8. The x-, y- and z-axes in the drawings show directions common in all of the drawings.

Figure 2:
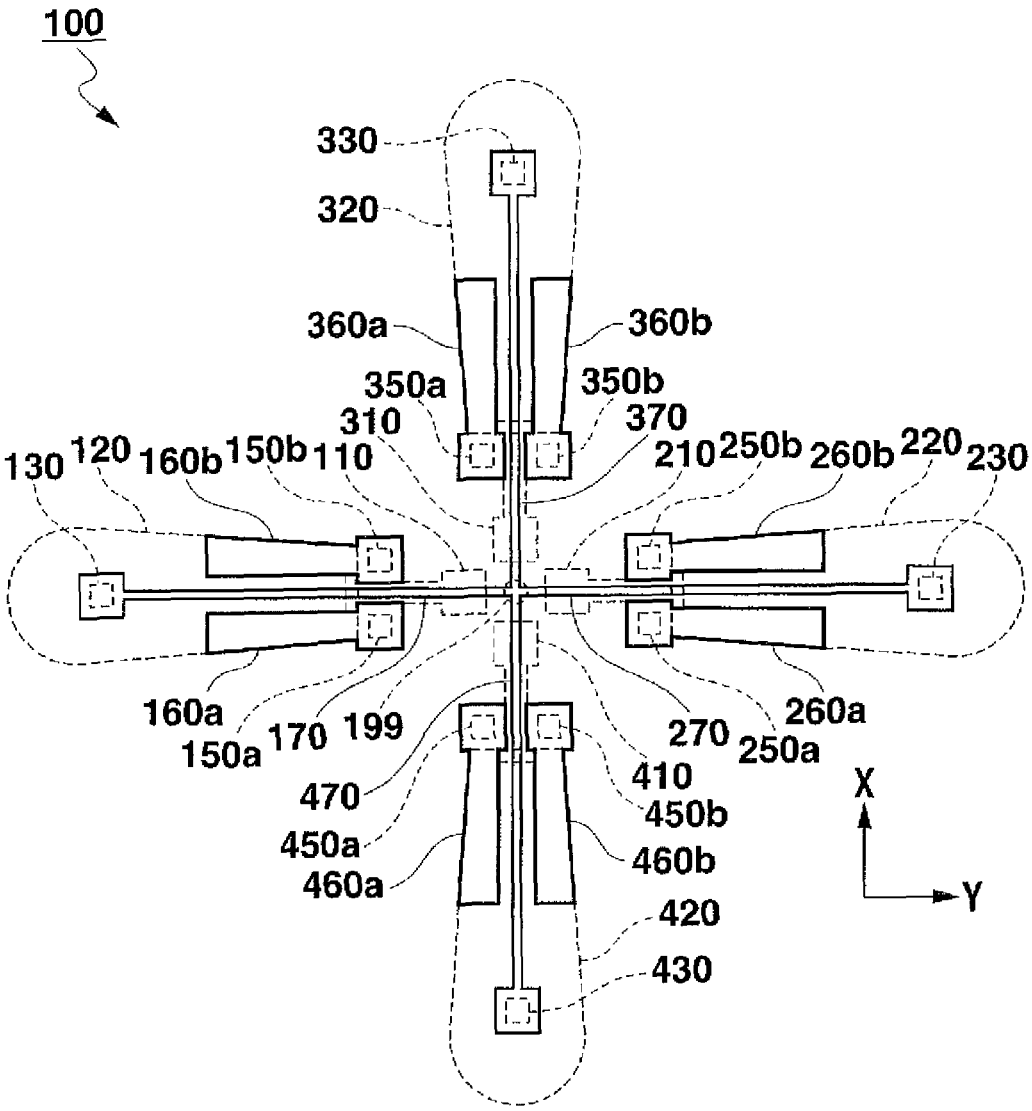
FIG. 2 is a bottom view of the multi-frequency circularly polarized antenna shown in FIG. 1.

As shown in FIG. 1, the multi-frequency circularly polarized antenna 100 comprises a multi-frequency antenna 900 and a multi-frequency antenna 901. The multi-frequency antenna 900 and the multi-frequency antenna 901 have the same composition, and the multi-frequency circularly polarized antenna 100 is configured such that the multi-frequency antenna 900 and the multi-frequency antenna 901 are connected substantially orthogonally at a center point 199. Specifically, shunt-inductor conductors 170 and 270 of the multi-frequency antenna 900 and shunt-inductor conductors 370 and 470 of the multi-frequency antenna 901 are connected substantially orthogonally at the center point 199, as shown in FIG. 2. The shunt-inductor conductors 170, 270, 370 and 470 are described below.

The composition of the multi-frequency antenna 900 and the multi-frequency antenna 901 configuring the multi-frequency circularly polarized antenna 100 is explained next. As noted above, the multi-frequency antenna 900 and the multi-frequency antenna 901 have the same composition, so components of the multi-frequency antenna 901 are noted in parentheses.

Figure 3:
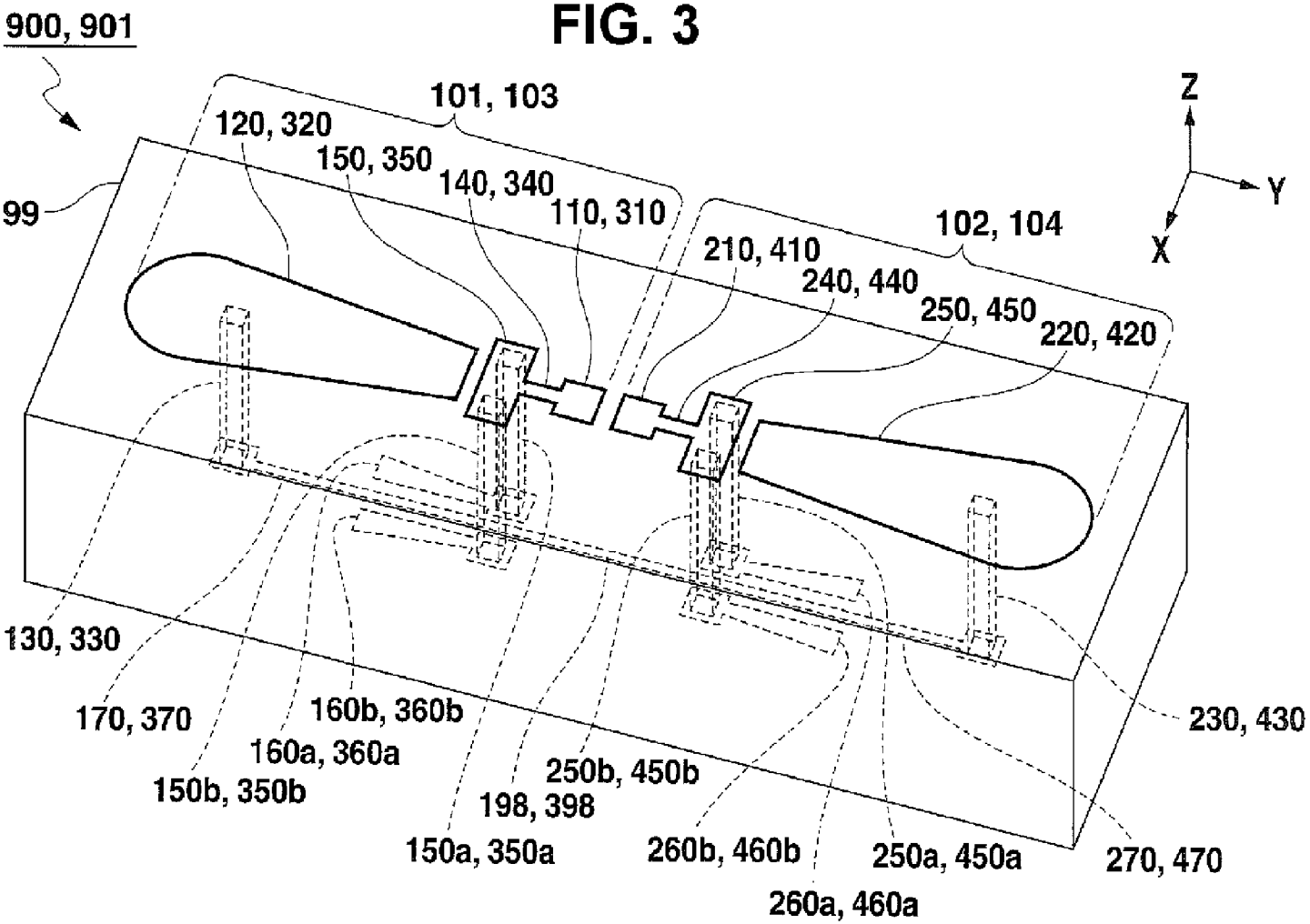
FIG. 3 is an oblique view of a multi-frequency antenna configuring the multi-frequency circularly polarized antenna shown in FIG. 1.
Figure 4:
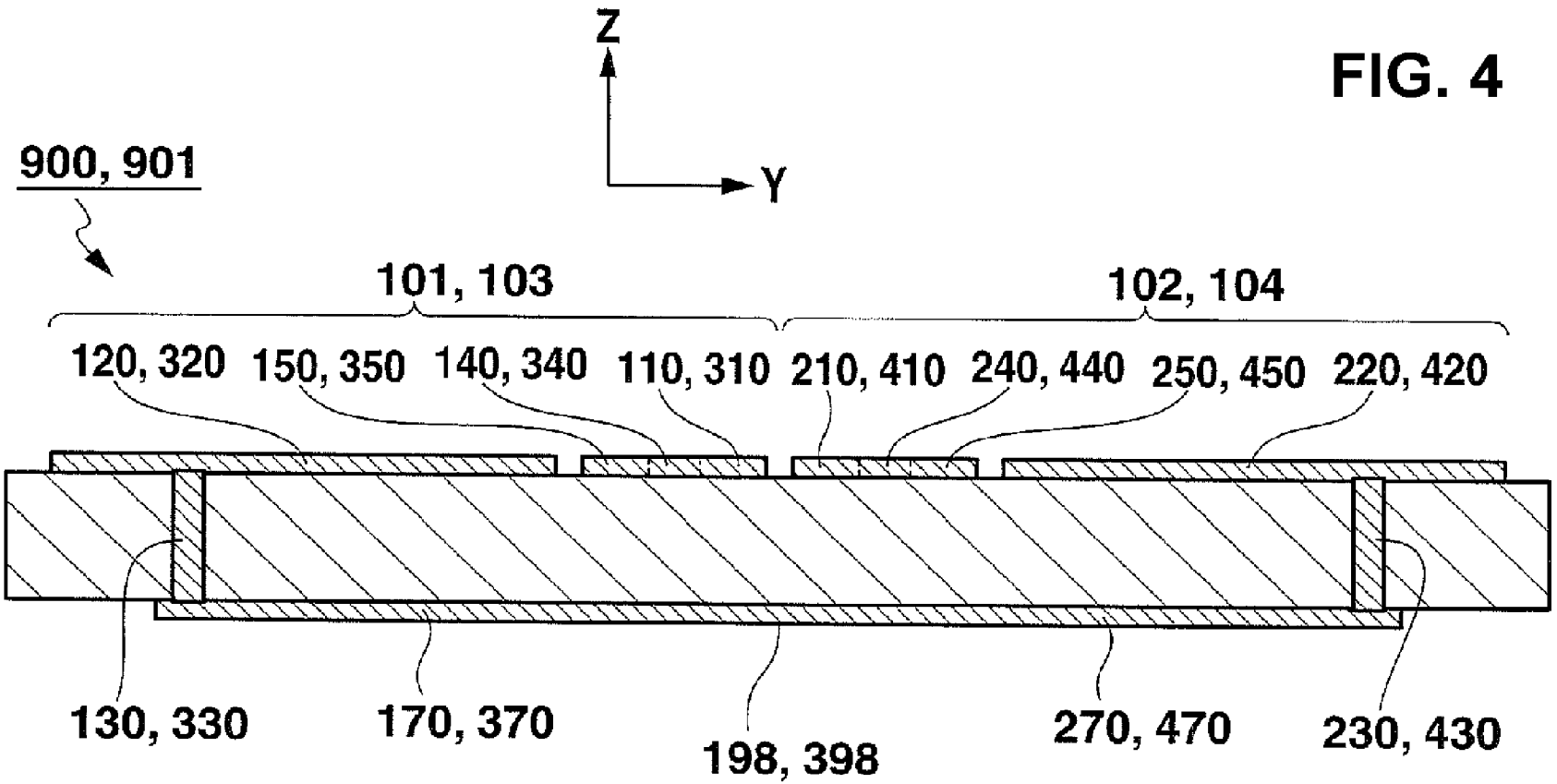
FIG. 4 is a cross-sectional view of a multi-frequency antenna configuring the multi-frequency circularly polarized antenna shown in FIG. 1.

The multi-frequency antenna 900 (901) comprises a substrate 99 and multi-frequency antennas 101 and 102 (103 and 104), as shown in FIGS. 3 and 4.

The substrate 99 is a board-like dielectric and is composed for example of a glass epoxy substrate (FR4).

The multi-frequency antenna 101 (103) and the multi-frequency antenna 102 (104) have the same composition and are arranged on the substrate 99 substantially mirror-image symmetrically so that the main transmission directions of the electromagnetic waves each radiate is the same direction. The multi-frequency antennas 101 and 102 (103 and 104) comprise input/output terminals 110 and 210 (310 and 410), antenna elements 120 and 220 (320 and 420), vias 130, 150*a*, 150*b*, 230, 250*a*, 250*b* (330, 350*a*, 350*b*, 430, 450*a*, 450*b*), via conductors 150 and 250 (350 and 450), series-inductor conductors 140 and 240 (340 and 440), series-capacitor conductors 160*a*, 160*b*, 260*a* and 260*b* (360*a*, 360*b*, 460*a* and 460*b*), and shunt-inductor conductors 170 and 270 (370 and 470).

The input/output terminals 110 and 210 (310 and 410) are formed close to the very center of one main surface of the substrate 99, with one end thereof connected to the other end of the series-inductor conductors 140 and 240 (340 and 440). A pair of unrepresented feeder lines are connected to the input/output terminals 110 and 210 (310 and 410) and supply differential signals. The input/output terminals 110 and 210 (310 and 410) function as power supply points.

The antenna elements 120 and 220 (320 and 420) comprise a conductor in the shape of an isosceles trapezoid with the bottom edge being longer than the top edge, and a semicircular conductor connected to the bottom edge of that isosceles trapezoid. The antenna element 120 (320) and the antenna element 220 (420) are arranged on one main surface of the substrate 99 so that the top edge of the isosceles trapezoid of each are mutually opposing.

The vias 130 and 230 (330 and 430) are formed passing through substantially the intersection of the two diagonal lines of the isosceles trapezoid configuring the antenna elements 120 and 220 (320 and 420), from one main surface of the substrate 99 to the other main surface. The inside of the vias 130 and 230 (330 and 430) are filled with a conductor one end of which is connected to the antenna elements 120 and 220 (320 and 420).

Via conductors 150 and 250 (350 and 450) are positioned on one main surface of the substrate 99. The via conductors 150 and 250 (350 and 450) are connected to the series-capacitor conductors 160*a* and 160*b*, and 260*a* and 260*b* (360*a* and 360*b*, and 460*a* and 460*b*), by means of two vias 150*a* and 150*b*, and 250*a* and 250*b* (350*a* and 35*b*, and 450*a* and 450*b*), formed passing from one main surface of the substrate 99 to the other main surface.

The series-inductor conductors 140 and 240 (340 and 440) comprise line conductors, are formed on one main surface of the substrate 99 and one end thereof is connected to the via conductors 150 and 250 (350 and 450).

The series-capacitor conductor 160*a* (360*a*) and the series-capacitor conductor 160*b* (360*b*) are positioned facing one part of the antenna element 120 (320) on the other main surface of the substrate 99 so that the shunt-inductor capacitor 170 (370) is interposed in between. A series capacitor connected in series to the antenna element 120 (320) is formed of the opposing parts of the series-capacitor conductors 160*a* and 160*b* (360*a* and 360*b*) and part of the antenna element 120 (320), and the part of the substrate 99 positioned therebetween.

Similarly, the series-capacitor conductor 260*a* (460*a*) and series-capacitor conductor 260*b* (460*b*) are positioned facing one part of the antenna element 220 (420) on the other main surface of the substrate 99 so that the shunt-inductor capacitor 270 (470) is interposed in between. A series capacitor connected in series to the antenna element 220 (420) is formed of the opposing parts of the series-capacitor conductors 260*a* and 260*b* (460*a* and 460*b*) and part of the antenna element 220 (420), and the part of the substrate 99 positioned therebetween.

The shunt-inductor conductors 170 and 270 (370 and 470) comprise line conductors and extend on the other main surface of the substrate 99, and one end is connected to the other end of the vias 130 and 230 (330 and 430). The other ends of the shunt-inductor conductors 170 and 270 (370 and 470) are mutually connected at the center point 199 substantially in the center of the other main surface of the substrate 99. That is to say, the multi-frequency antenna 101 (103) and the multi-frequency antenna 102 (104) are mutually connected at the center point 199.

The multi-frequency antenna 900 (901) emits a transmission signal supplied between the input/output terminals 110 and 210 (310 and 410) into space as radio waves, and converts received radio waves into electrical signals and transmits such to a feeder line from the input/output terminals 110 and 210 (310 and 410).

The multi-frequency antenna 900 (901) having the above-described composition is produced for example by opening vias 130, 150*a*, 150*b*, 230, 250*a* and 250*b* (330, 350*a*, 350*b*, 430, 450*a* and 450*b*) in the substrate 99, filling these openings with plating and/or the like, then attaching copper foil to both surfaces of the substrate 99 and patterning the copper foil through PEP (optical etching method) and/or the like.

Figure 5:
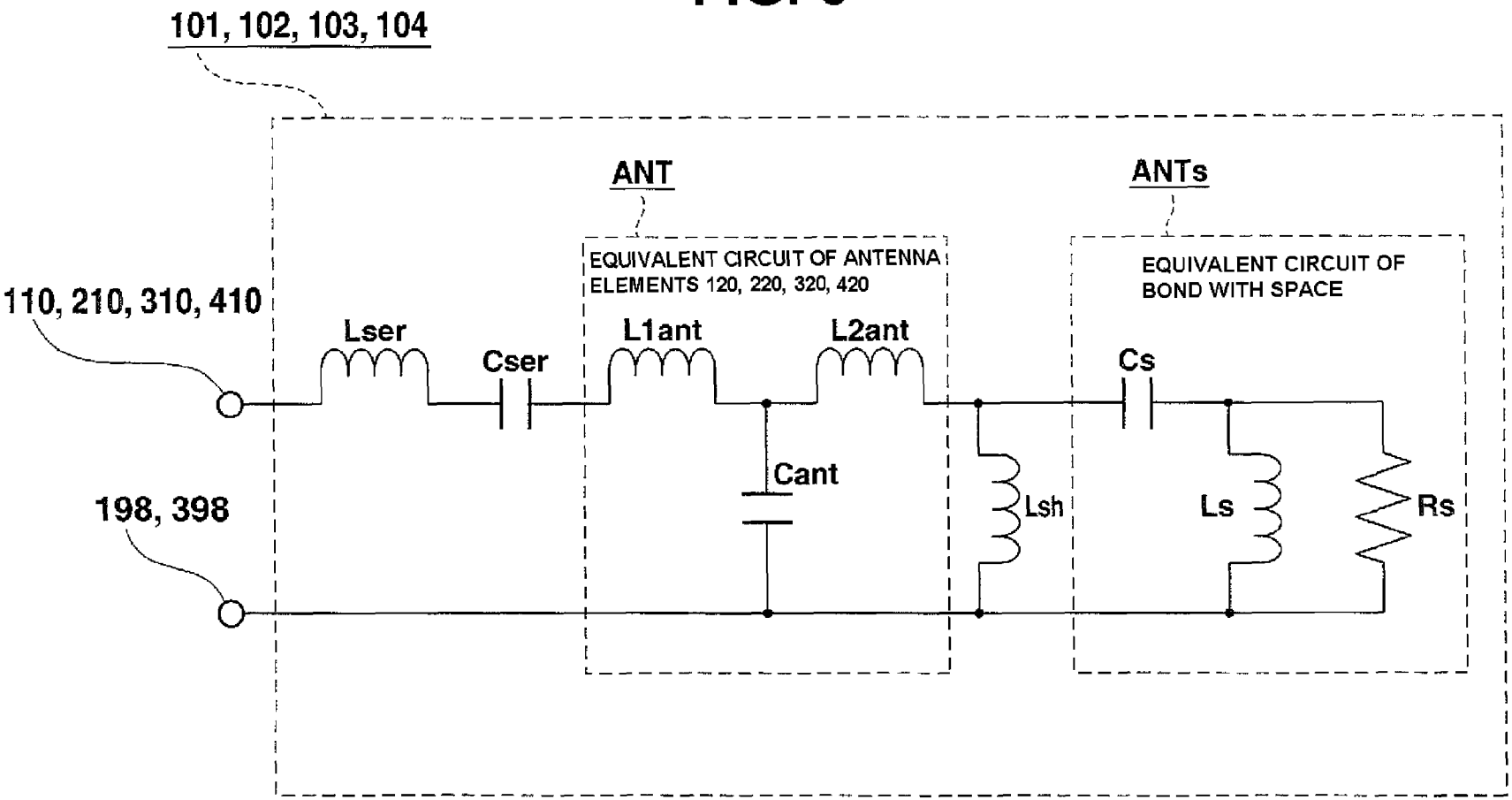
FIG. 5 is a drawing showing a portion of an equivalent circuit of the multi-frequency circularly polarized antenna shown in FIG. 1.
Figure 6:
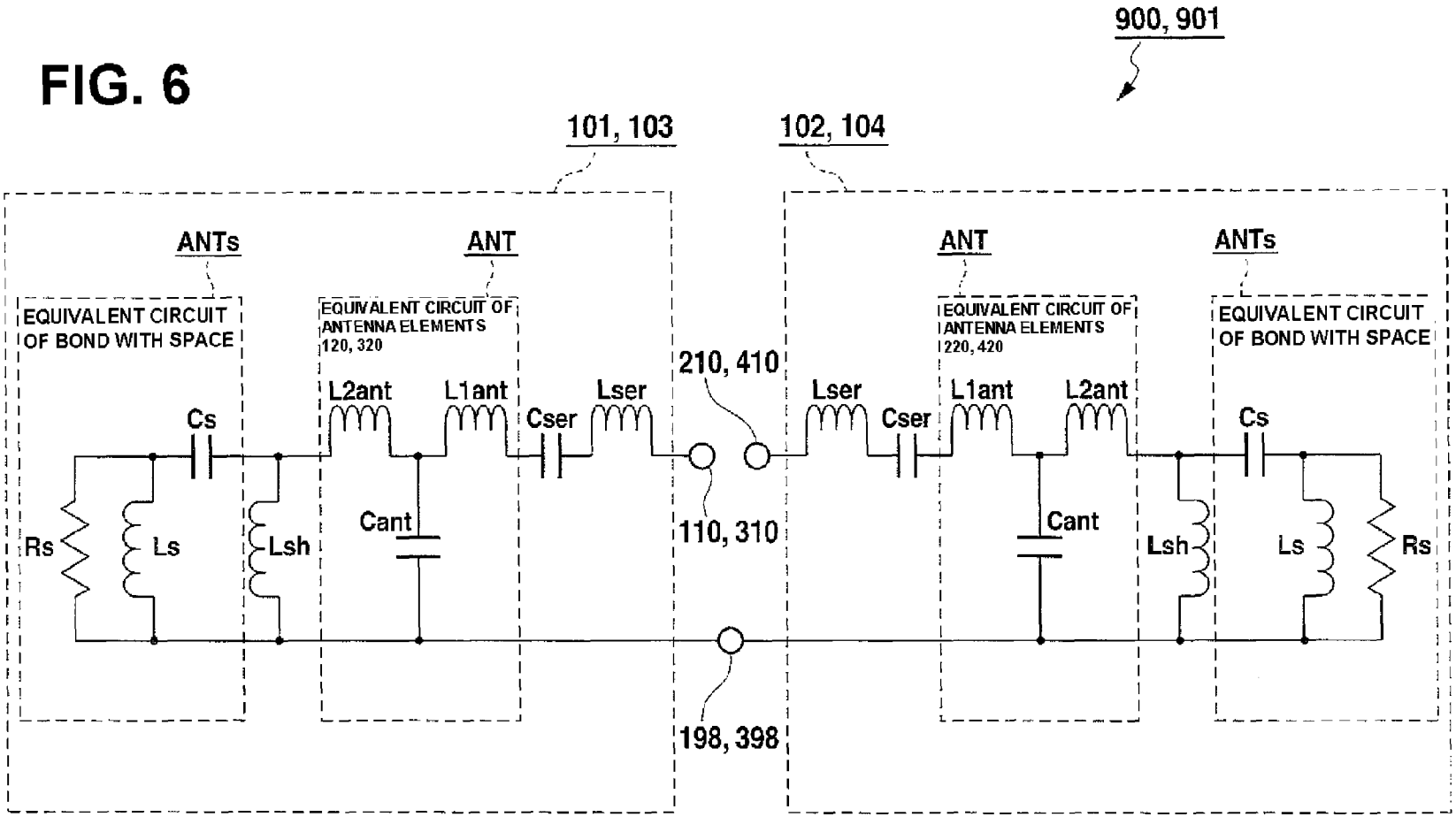
FIG. 6 is a drawing showing an equivalent circuit of a multi-frequency antenna configuring the multi-frequency circularly polarized antenna shown in FIG. 1.

The electrical composition of the multi-frequency antennas 101 and 102 (103 and 104) configuring the multi-frequency antenna 900 (901) having the above-described physical composition is expressed by the equivalent circuit shown in FIG. 5.

As shown in this drawing, the multi-frequency antennas 101 and 102 (103 and 104) electrically comprise a series inductor Lser, a series capacitor Cser, an equivalent circuit ANT of the antenna elements 120 and 220 (320 and 420), a shunt inductor Lsh, an equivalent circuit ANTs of the bond with space, the input/output terminals 110 and 210 (310 and 410), and a connection point 198 (398).

The series inductor Lser corresponds to the inductance of the series-inductor conductors 140 and 240 (340 and 440), and the shunt-inductor Lsh corresponds to the inductance of the shunt-inductor conductors 170 and 270 (370 and 470). In addition, the series capacitor Cser corresponds to the series capacitor formed by the series-capacitor conductors 160*a*, 160*b*, 260*a* and 260*b* and/or the like (360*a*, 360*b*, 460*a*, 460*b* and/or the like).

The equivalent circuit ANT of the antenna elements 120 and 220 (320 and 420) is a circuit expressing the input inductance with a right-hand line, and the comprises an inductor L1ant, an inductor L2ant and a capacitor Cant.

The inductance of the inductor L1ant, the inductance of the inductor L2ant and the capacitance of the capacitor Cant in the equivalent circuit ANT of the antenna elements 120 and 220 (320 and 420) are substantially dependent on the size and shape of the antenna elements 120 and 220 (320 and 420), and are substantially determined when the size and shape of the antenna elements 120 and 220 (320 and 420) are determined The equivalent circuit ANTs of the bond with space is dependent on the shape and size of the antenna elements 120 and 220 (320 and 420) and is a circuit expressing the impedance through the bond between space and the antenna elements 120 and 220 (320 and 420). The equivalent circuit ANTs of the bond with space comprises a capacitor Cs, a standard impedance Rs and an inductor Ls.

One end of the series circuit of the series inductor Lser and the series capacitor Cser is connected to the input/output terminals 110 and 210 (310 and 410).

The other end of the series circuit of the series inductor Lser and the series capacitor Cser is connected to one end of the inductor L1ant configuring the equivalent circuit ANT of the antenna elements 120 and 220 (320 and 420). The other end of the inductor L1ant is connected to one end of the capacitor Cant and one end of the inductor L2ant. The other end of the capacitor Cant is connected to the connection point 198 (398).

One end of the shunt inductor Lsh is connected to the other end of the inductor L2ant. The other end of the shunt inductor Lsh is connected to the connection point 198 (398).

One end of the capacitor Cs of the equivalent circuit ANTs of the bond with space is connected to the other end of the inductor L2ant and one end of the shunt inductor Lsh. The other end of the capacitor Cs is connected to one end of the inductor Ls and one end of the standard impedance Rs. The other end of the inductor Ls and the other end of the standard impedance Rs are connected to the connection point 198 (398).

The value of the standard impedance Rs in the equivalent circuit ANTs of the bond with space is dependent on the size and shape of the antenna elements 120 and 220 (320 and 420). The value of this standard impedance Rs is equivalent to the actual amount of impedance expressing the ratio of the impressed voltage and the flowing electric current when a voltage of the target frequency is impressed on the power supply point.

The inductance of the inductor Ls and the capacitance of the capacitor Cs in the equivalent circuit ANTs of the bond with space are dependent on the standard impedance Rs and the radius of a sphere containing the antenna elements 120 and 220 (320 and 420), and can be expressed by the following equations (1) and (2).

$$Cs=a/(c\times Rs) \quad (1)$$

$$Ls=(a\times Rs)/c \quad (2)$$

Here, Cs is the capacitance [F] of the capacitor Cs, Ls is the inductance [H] of the inductor Ls, Rs is the resistance [Ω] of the standard impedance Rs, a is the radius [m] of a sphere containing the antenna elements and c is the speed of light [m/s].

The multi-frequency antennas 101 and 102 (103 and 104) are mutually connected by the connection point 198 (398) and configure the multi-frequency antenna 900 (901). The electrical composition of the multi-frequency antenna 900 (901) is expressed by the equivalent circuit shown in FIG. 6. A pair of unrepresented feeder lines is connected to the input/output terminals 110 and 210 (310 and 410).

The above is the composition of the multi-frequency antennas 900 and 901 configuring the multi-frequency circularly polarized antenna 100.

The multi-frequency circularly polarized antenna 100 is configured such that the shunt-inductor conductors 170 and 270 of the multi-frequency antenna 900 and the shunt-inductor conductors 370 and 470 of the multi-frequency antenna 901 are connected so as to be roughly orthogonal at the center point 199 of each antenna, as shown in FIG. 2.

Figure 7:
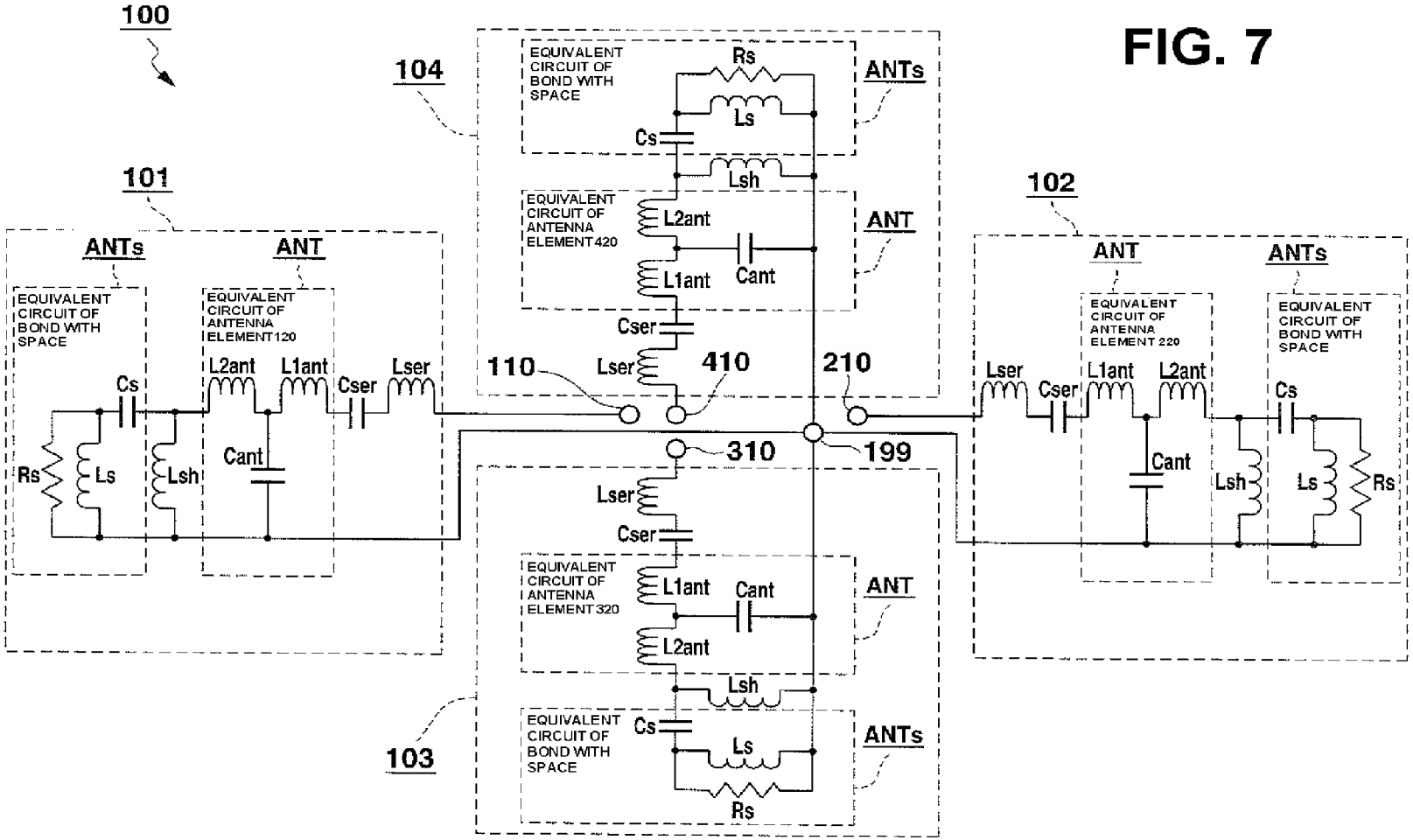
FIG. 7 is a drawing showing the entirety of an equivalent circuit of the multi-frequency circularly polarized antenna shown in FIG. 1.

The electrical composition of the multi-frequency circularly polarized antenna 100 is expressed by the equivalent circuit shown in FIG. 7. For the various frequencies used by the multi-frequency circularly polarized antenna 100, the patterns of the shunt-inductor conductors 170, 270, 370 and 470, the series-capacitor conductors 160*a*, 160*b*, 260*a*, 260*b*, 360*a*, 360*b*, 460*a* and 460*b* and the series-inductor conductors 140, 240, 340 and 440 are adjusted so that imaginary part of the input impedance becomes 0 and the real part becomes 50Ω.

The capacitance of the various capacitor and the inductance of the various inductors of the equivalent circuit ANTs for the bond with space of the antenna elements 120, 220, 320 and 420 can be found from the above-described equations (1) and (2).

With this preferred embodiment, the various patterns are adjusted so that the imaginary part of the input impedance becomes 0 and the real part becomes 50Ω at the two frequencies 2.5 GHz and 5.2 GHz.

Figure 8A:
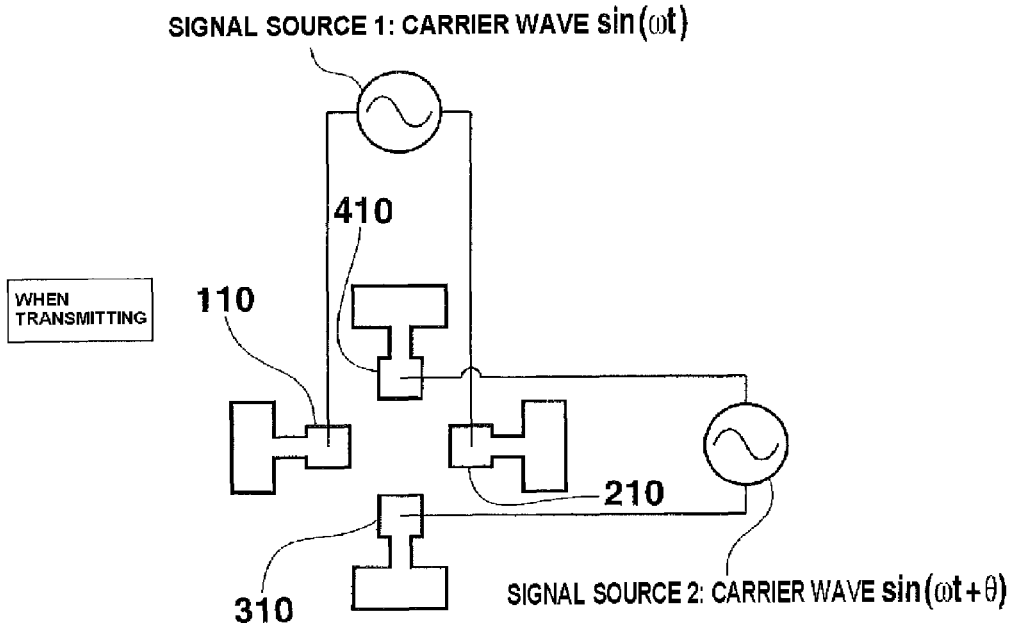
FIG. 8A is an enlarged view of an input/output terminal portion showing the transmission-time composition of the multi-frequency circularly polarized antenna shown in FIG. 1.
Figure 8B:
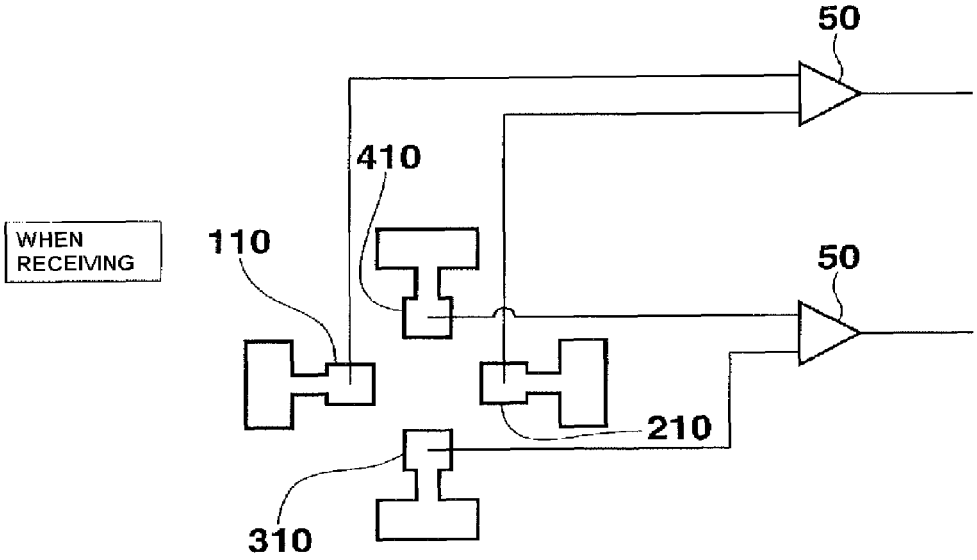
FIG. 8B is an enlarged view of an input/output terminal portion showing the reception-time composition of the multi-frequency circularly polarized antenna shown in FIG. 1.

The input/output terminals 110, 210, 310 and 410 of the multi-frequency circularly polarized antenna 100 are connected to signal sources 1 or 2 via feeder lines, as shown in FIG. 8A. In addition, the input/output terminals 110, 210, 310 and 410 are connected to amplifiers 50 via feeder lines, as shown in FIG. 8B. The amplifiers 50 comprise op amps (operational amplifier) and/or the like, for example.

The multi-frequency circularly polarized antenna 100 when transmitting emits a transmission signal supplied between the input/output terminals 110, 210, 310 and 410 as radio waves to space, and when receiving converts radio waves received into electrical signals and transmits such to feeder lines from the input/output terminals 110, 210, 310 and 410.

The action of the multi-frequency circularly polarized antenna 100 when transmitting is described next. As shown in FIG. 8A, this signal is supplied to the input/output terminals 110 and 210, which are a pair. Similarly, this signal is supplied to the input/output terminals 310 and 410, which are a pair.

The multi-frequency circularly polarized antenna 100 emits to space linearly polarized waves or elliptically polarized waves in accordance with the phase difference between the signal supplied to the input/output terminals 110 and 210 and the signal supplied to the input/output terminals 310 and 410.

Specifically, when the signal supplied to the input/output terminals 110 and 210 and the signal supplied to the input/output terminals 310 and 410 are in-phase (the phase θ of the carrier wave in FIG. 8A is 0), the linearly polarized waves emitted by the multi-frequency antennas 900 and 901 are also in-phase. Because the two orthogonal linearly polarized waves are in-phase, the composite wave is also linear. Accordingly, the multi-frequency circularly polarized antenna 100 emits a linearly polarized wave.

In contrast, when there is a phase difference between the signal supplied to the input/output terminals 110 and 210 and the signal supplied to the input/output terminals 310 and 410 (when the phase θ of the carrier wave in FIG. 8A is not 0), the same phase difference occurs in the linearly polarized wave emitted by the multi-frequency antennas 900 and 901. Because there is a phase difference between the two orthogonal linearly polarized waves, the composite wave becomes an elliptically polarized wave. Accordingly, the multi-frequency circularly polarized antenna 100 emits an elliptically polarized wave.

In particular, when the phase difference between the signal supplied to the input/output terminals 110 and 210 and the signal supplied to the input/output terminals 310 and 410 is $\pm\pi/2$ (the phase θ of the carrier wave in FIG. 8A is $\pm\pi/2$) and the amplitude of these signals is equal, the phase difference between the two orthogonal linearly polarized waves emitted by the multi-frequency antennas 900 and 901 is $\pm\pi/2$. Consequently, the composite wave thereof is a circularly polarized wave and the multi-frequency circularly polarized antenna 100 emits a circularly polarized wave.

The action of the multi-frequency circularly polarized antenna 100 when receiving is described next. The multi-frequency circularly polarized antenna 100 converts the radio waves received into an electrical signal and conveys such to the amplifiers 50 via feeder lines from the input/output terminals 110 and 210, which are a pair. Similarly, an electrical signal is conveyed to the amplifiers 50 via feeder lines from the input/output terminals 310 and 410, which are also a pair As described above, at 2.5 GHz and 5.2 GHz the imaginary part of the input impedance becomes 0, and the multi-frequency circularly polarized antenna 100 resonates at those frequencies and the gain becomes larger. Accordingly, at the two frequencies of 2.5 GHz and 5.2 GHz, the multi-frequency circularly polarized antenna 100 functions as a multi-frequency circularly polarized antenna that can obtain sufficient gain.

As described above, with the multi-frequency circularly polarized antenna 100, a lightweight, thin and compact circularly polarized antenna acting at multiple resonant frequencies by supplying signals with a phase difference of $\pi/2$ can be realized.

(Variation)

The present invention is not limited to the above-described first preferred embodiment, for various variations and applications are possible. For example, in the above-described first preferred embodiment, an example was disclosed in which resonance occurred and gain increased in two frequency ranges, near 2.5 GHz and near 5.2 GHz, but this is intended to be illustrative and not limiting.

For example, combinations of two arbitrary frequencies ranges are possible. As described above, the element number of the equivalent circuit ANTs of the bond with space and the equivalent circuit ANT of the antenna elements 120, 220, 320 and 420 are automatically determined by the size of the antenna elements 120, 220, 320 and 420. Consequently, it is possible to obtain sufficient gain in arbitrary multiple frequency ranges by appropriately setting the inductance of the shunt-inductor Lsh, the capacitance of the series capacitor Cser and the inductance of the series inductor Lser so that resonant points occur near the multiple frequencies targeted, taking into consideration the various element numbers determined by the size of the antenna elements 120, 220, 320 and 420.

Second Preferred Embodiment

The multi-frequency circularly polarized antenna 100 according to the above-described first preferred embodiment emitted circularly polarized waves by supplying signals with a phase difference of $\pm\pi/2$ to two input terminal pairs. The multi-frequency circularly polarized antenna 200 according to this preferred embodiment emits circularly polarized waves by means of one input terminal pair by causing a phase difference of $\pm\pi/2$ without adding a new circuit for controlling phase through a phase line, by adjusting the value of the convergent constant component positioned in the antenna itself.

Below, the multi-frequency circularly polarized antenna 200 according to the second preferred embodiment is described.

Figure 9:
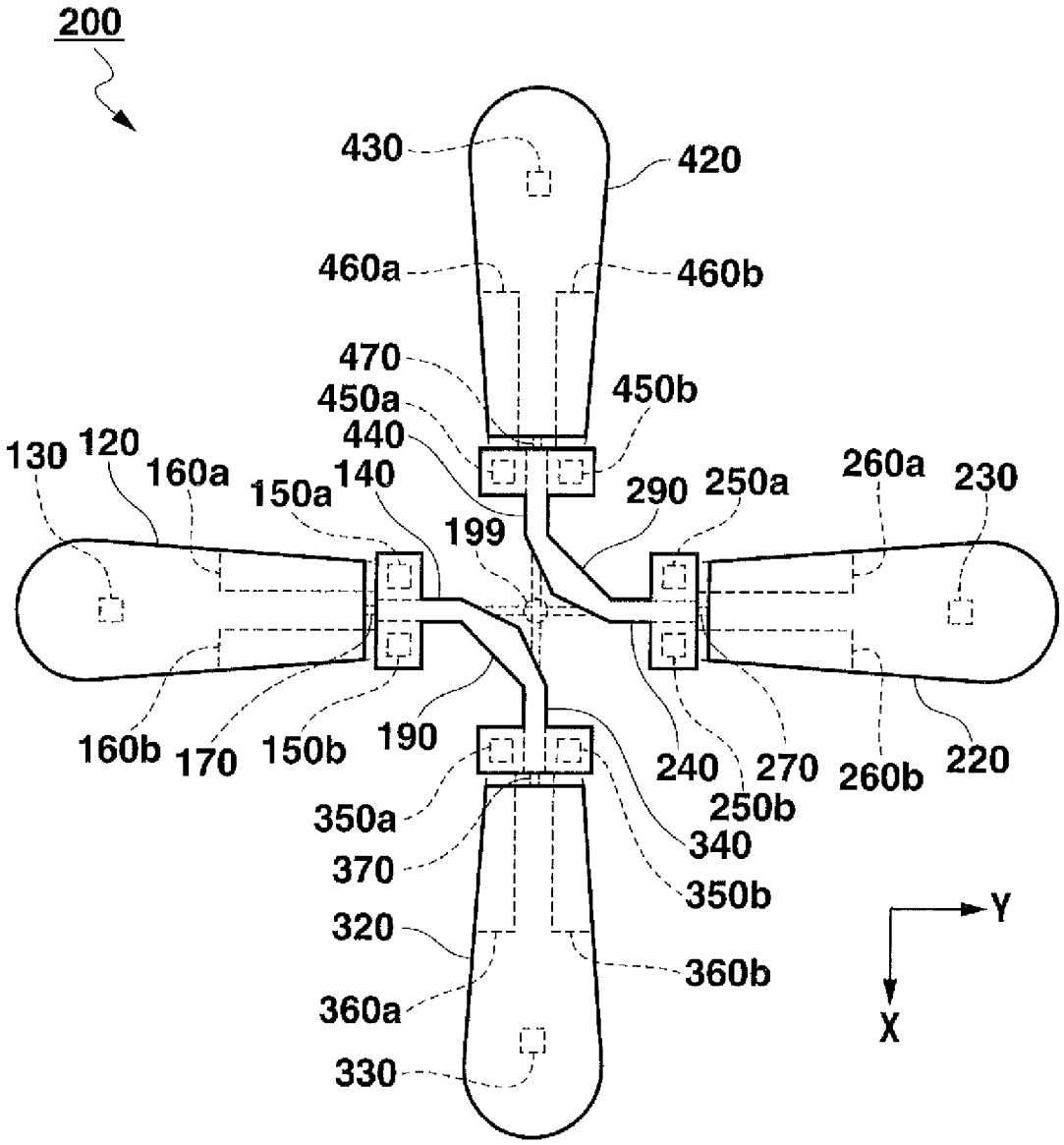
FIG. 9 is a planar view of a multi-frequency circularly polarized antenna according to a second preferred embodiment of the present invention.
Figure 10:
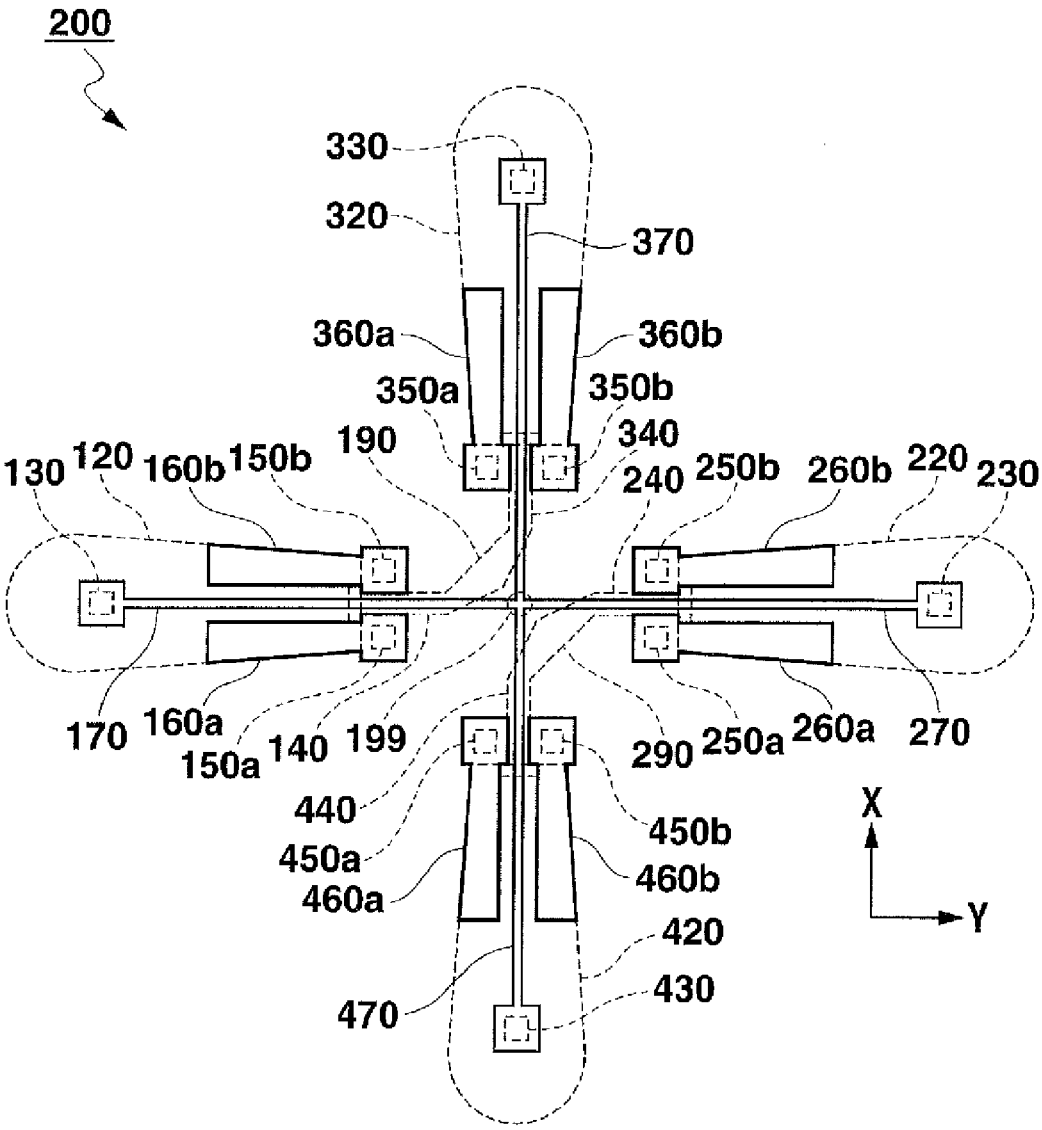
FIG. 10 is a bottom view of the multi-frequency circularly polarized antenna shown in FIG. 9.
Figure 11:
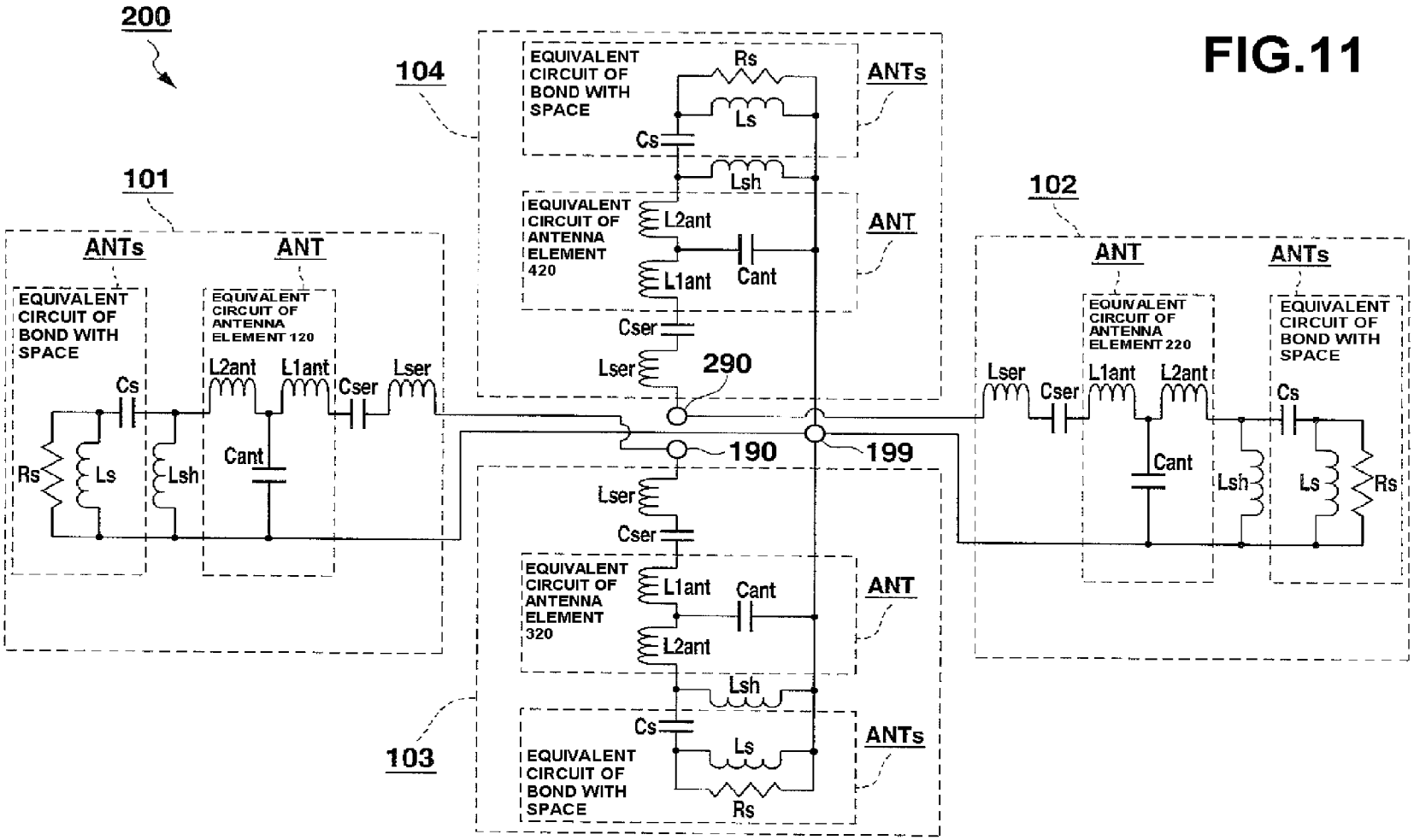
FIG. 11 is a drawing showing an equivalent circuit of the multi-frequency circularly polarized antenna shown in FIG. 9.

As shown in FIGS. 9 and 10, the multi-frequency circularly polarized antenna 200 is such that one input/output terminal 190 is configured by the input/output terminals 110 and 310 of the multi-frequency circularly polarized antenna 100 according to the first preferred embodiment being connected, and similarly, one input/output terminal 290 is configured by the input/output terminals 210 and 410 of the multi-frequency circularly polarized antenna 100 according to the first preferred embodiment being connected. Other compositions are the same as in the multi-frequency circularly polarized antenna 100 according to the first preferred embodiment. The electrical composition of the multi-frequency circularly polarized antenna 200 is expressed by the equivalent circuit shown in FIG. 11.

Figure 13A:
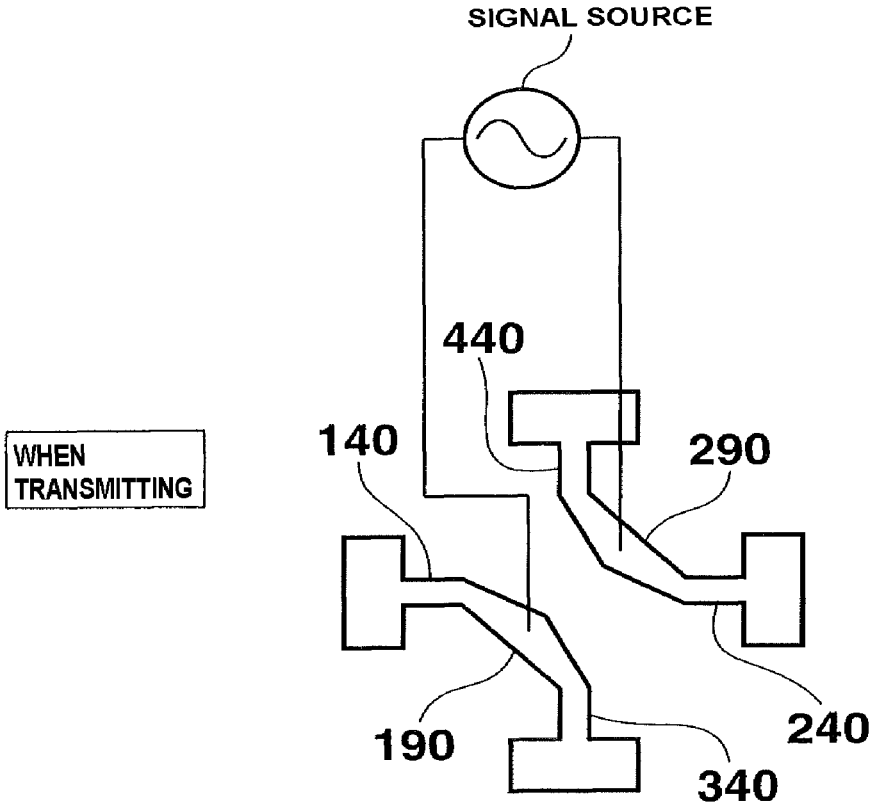
FIG. 13A is an enlarged view of an input/output terminal portion showing the transmission-time composition of the multi-frequency circularly polarized antenna shown in FIG. 9.

The input/output terminal 190 and the input/output terminal 290 are connected to a signal source via feeder lines, as shown in FIG. 13A. When transmitting, the multi-frequency circularly polarized antenna 200 emits circularly polarized waves by signals being supplied to the input/output terminals 190 and 290 from this signal source.

Figure 13B:
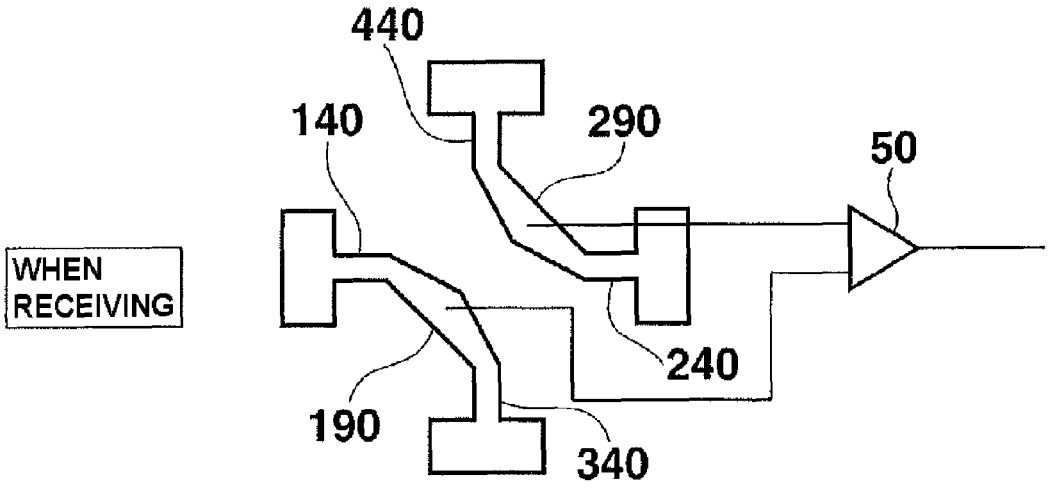
FIG. 13B is an enlarged view of an input/output terminal portion showing the reception-time composition of the multi-frequency circularly polarized antenna shown in FIG. 9.

In addition, the input/output terminals 190 and 290 are connected to an amplifier 50, as shown in FIG. 13B. The multi-frequency circularly polarized antenna 200 converts received circularly polarized waves into electrical signals and conveys the electrical signals to the amplifier 50 from the input/output terminals 190 and 290.

The multi-frequency circularly polarized antenna 200 combines signals provided to the pair of input/output terminals comprising the input/output terminal 190 and the input/output terminal 290 inside the antenna and generates a phase difference $\pm\pi/2$. Consequently, the value of the convergent constant component of the shunt inductor Lsh, the series capacitor Cser and the series inductor Lser in the antenna conductor of the multi-frequency circularly polarized antenna 200 are adjusted.

Specifically, the value of the convergent constant component is adjusted as follows.

Figure 12:
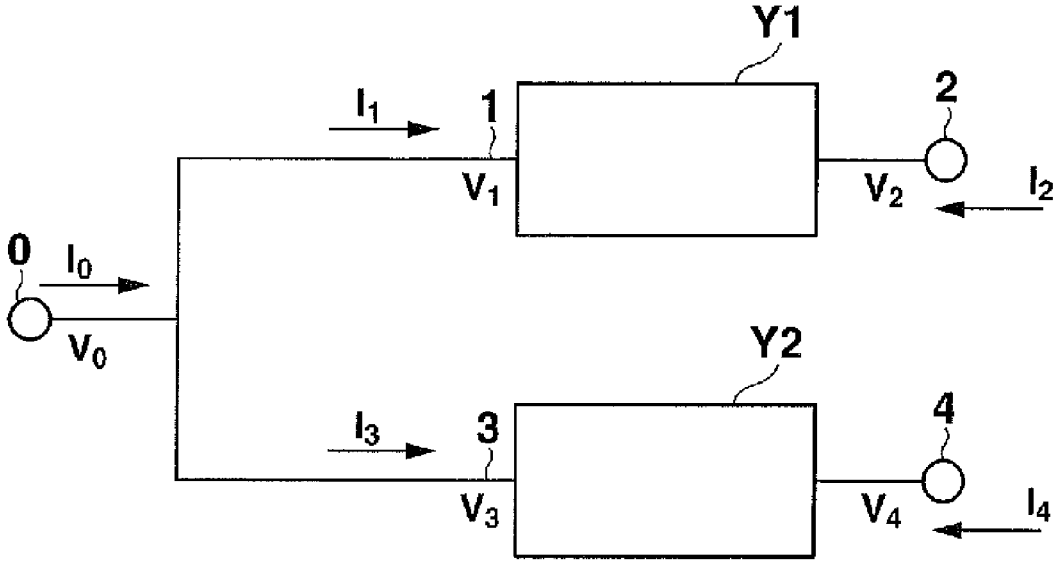
FIG. 12 is a drawing showing an equivalent circuit of the multi-frequency circularly polarized antenna shown in FIG. 9.

The multi-frequency circularly polarized antenna 200 is expressed by the equivalent circuit shown in FIG. 12 because the input side is short-circuited. When the terminals of Y1 are taken to be terminal 1 and terminal 2, and the terminals of Y2 are taken to be terminal 3 and terminal 4, and this is expressed using a Y matrix:

$$I1=Y11V1+Y12V2$$

$$I2=Y21V1+Y22V2$$

$$I3=Y33V3+Y34V4$$

$$I4=Y43V3+Y44V4$$

$$V1=V3=0$$

$$I0=I1+I3.$$

From considering that the terminal 1 and the terminal 3 are short-circuited resulting in a three-terminal circuit, when the terms for the electric current and voltage of the terminal 1 and the terminal 3 are eliminated, the Y matrix becomes as follows.

[Formula 1]

$$Y = \begin{bmatrix} Y_{11} + Y_{33} & Y_{12} & Y_{34} \\ Y_{21} & Y_{22} & 0 \\ Y_{43} & 0 & Y_{44} \end{bmatrix} \quad (3)$$

An S parameter for causing the phase difference of $\pm\pi/2$ that is a condition of circularly polarized waves to be generated inside the multi-frequency circularly polarized antenna 200 can be expressed as below.

[Formula 2]

$$S = \begin{bmatrix} 0 & e^{j\alpha}/\sqrt{2} & \pm je^{j\alpha}/\sqrt{2} \\ e^{j\alpha}/\sqrt{2} & e^{j\beta}/2 & \mp je^{j\beta}/2 \\ \pm je^{j\alpha}/\sqrt{2} & \mp je^{j\beta}/2 & -e^{j\beta}/2 \end{bmatrix} \quad (4)$$

The value of the convergent constant component of the multi-frequency circularly polarized antenna 200 is adjusted so that the above-described equations 3 and 4 match.

By adjusting the value of the convergent constant component in this manner, the signals given to the input/output terminals 190 and 290 of the multi-frequency circularly polarized antenna 200 are combined as radio waves by the antenna internally and are emitted as a dextrorotatory polarized waves.

By adjusting the value of the convergent constant component of the multi-frequency circularly polarized antenna 200 in this manner, it is possible to realize a multi-frequency circularly polarized antenna 200 of the same size as the multi-frequency circularly polarized antenna 100 of the above-described first preferred embodiment without adding new circuits for controlling phase through phase lines and/or the like.

(Variation)

The present invention is not limited to the above-described second preferred embodiment, for various variations and applications are possible. For example, in this above-described second preferred embodiment, an example was disclosed in which the input/output terminals 190 and 290 are configured by connecting the input/output terminals 110 and 310, and the input/output terminals 210 and 410, of the multi-frequency circularly polarized antenna 100 of the above-described first preferred embodiment, but this is intended to be illustrative and not limiting. The input/output terminals 190 and 290 may be configured by connecting the input/output terminals 110 and 410, and the input/output terminals 210 and 310, of the multi-frequency circularly polarized antenna 100 of the above-described first preferred embodiment. In this case, the signal given to the input/output terminals 190 and 290 of the multi-frequency circularly polarized antenna 200 are combined as radio waves inside the antenna and emitted as levorotatory polarized waves.

Figure 14:
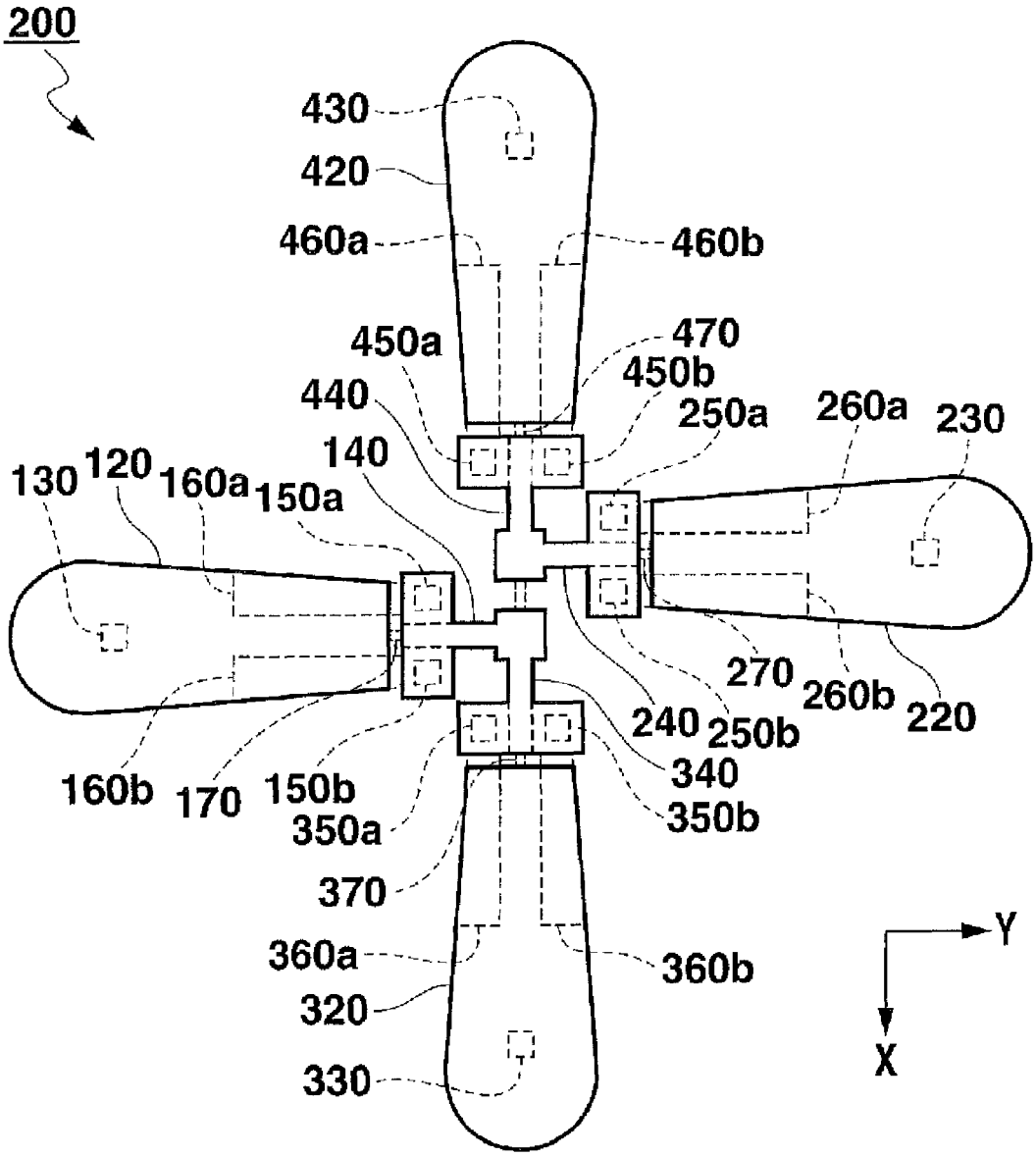
FIG. 14 is a planar view of a variation of the multi-frequency circularly polarized antenna shown in FIG. 9.
Figure 15:
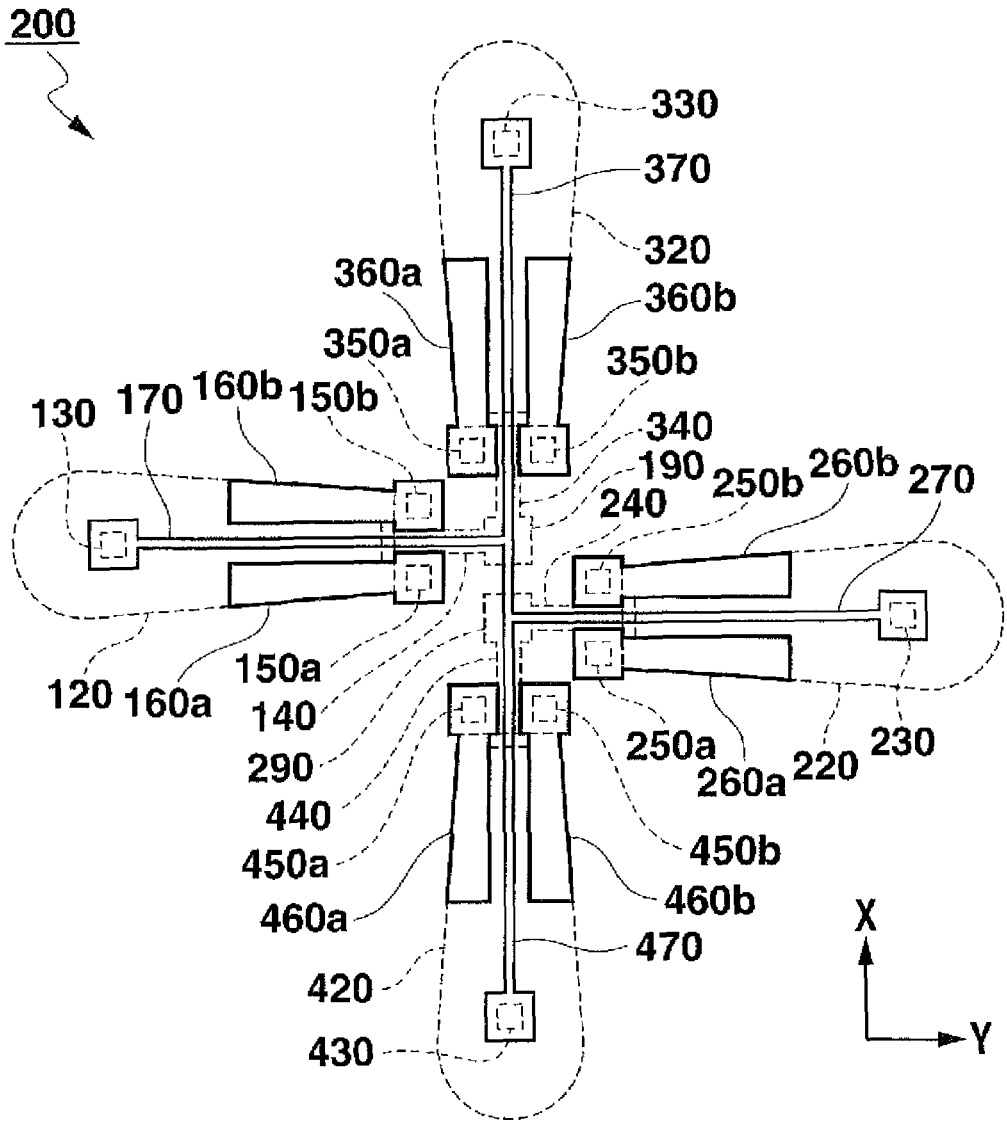
FIG. 15 is a bottom view of the multi-frequency circularly polarized antenna shown in FIG. 14.

In addition, in the above-described second preferred embodiment, an example was disclosed in which the multi-frequency circularly polarized antenna 200 is configured in a roughly cross shape, as shown in FIGS. 9 and 10, but this is intended to be illustrative and not limiting. The multi-frequency circularly polarized antenna 200 may not configured in a cross shape if one of the adjacent input/output terminals is connected, for example as shown in FIGS. 14 and 15.

Third Preferred Embodiment

The multi-frequency circularly polarized antenna 200 according to the above-described second preferred embodiment emits dextrorotatory polarized waves or levorotatory polarized waves by signals being supplied to one input/output terminal pair. A multi-frequency circularly polarized antenna 300 according to this preferred embodiment switches the rotation direction of the circularly polarized waves through a switching action by providing a switching element between the input/output terminals of the above-described first multi-frequency circularly polarized antenna 100.

Below, the multi-frequency circularly polarized antenna 300 according to the third preferred embodiment is described. The value of the convergent constant component of the multi-frequency circularly polarized antenna 300 is adjusted the same as in the second preferred embodiment.

Figure 16:
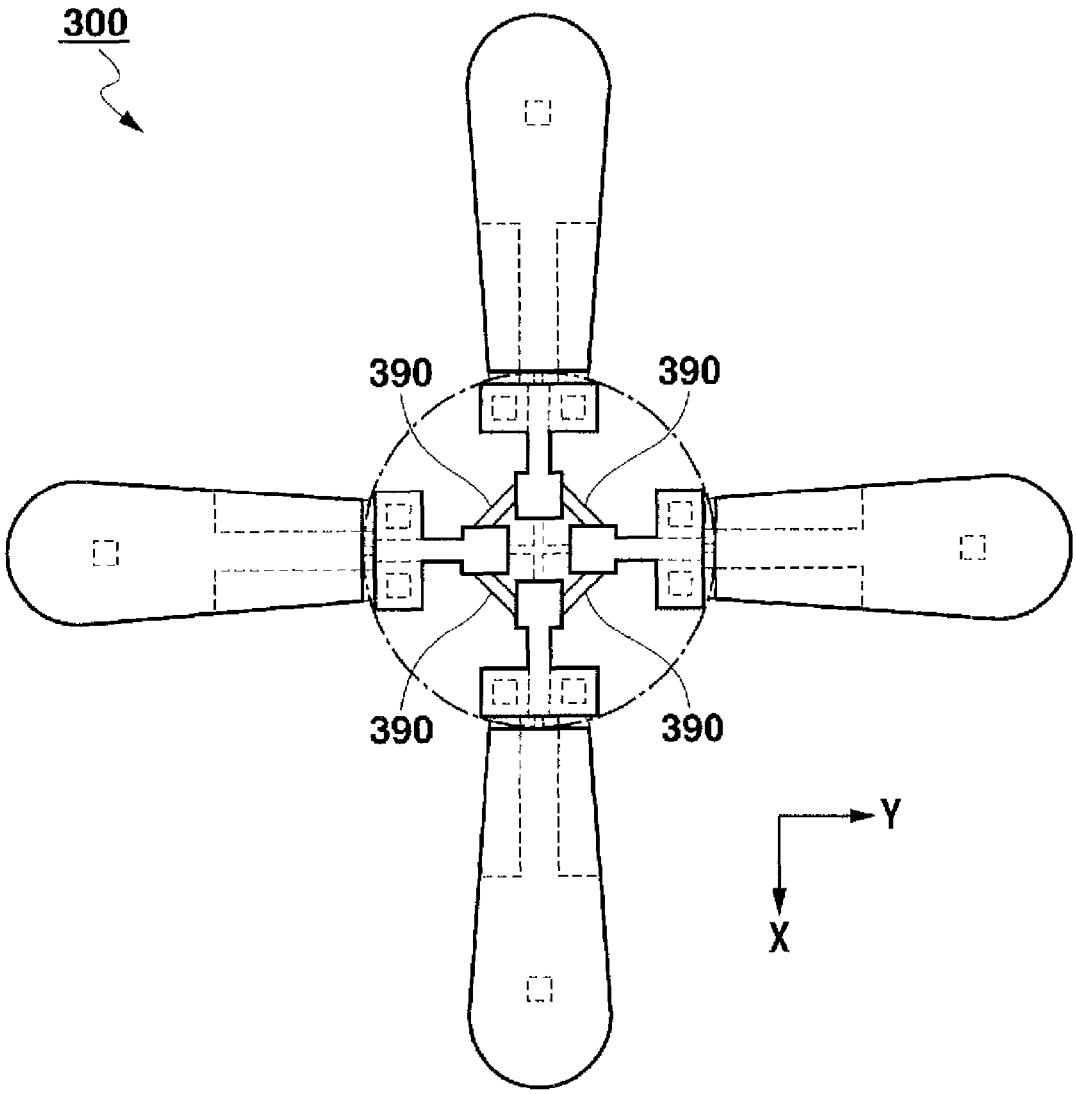
FIG. 16 is a planar view of a multi-frequency circularly polarized antenna according to a third preferred embodiment of the present invention.

The multi-frequency circularly polarized antenna 300 is provided with switching elements 390 that alternatively connect adjacent input/output terminals of the multi-frequency circularly polarized antenna 100 according to the first preferred embodiment, as shown in FIG. 16.

The switching elements 390 comprise semiconductor switches and/or the like and turn on and off in accordance with control signals transmitted from outside. The switching elements 390 act so that when the input/output terminals are connected and one switching element 390 between adjacent input/output terminals is on, the switching element 390 between the other adjacent input/output terminals is off.

Figure 17A:
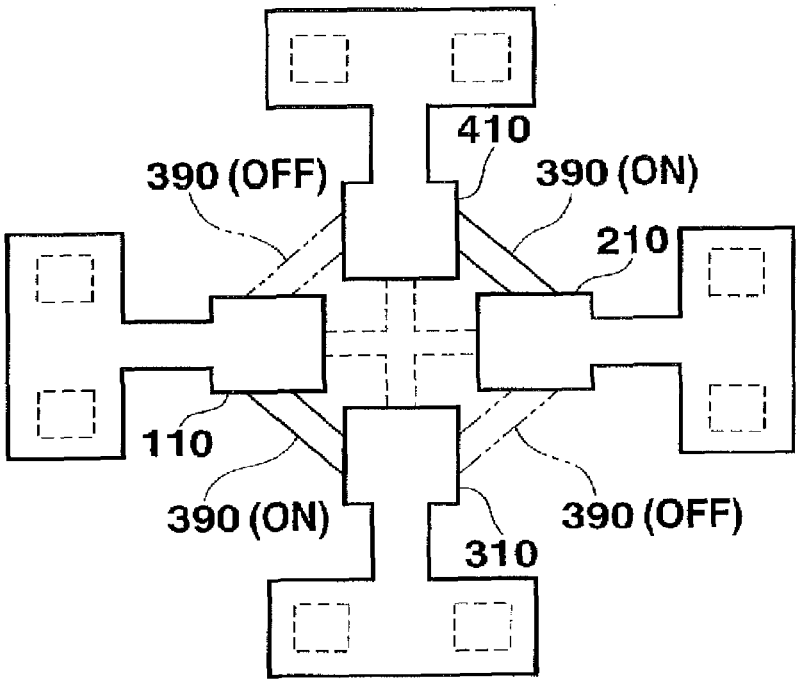
FIG. 17A is an enlarged view of an input/output terminal portion of the multi-frequency circularly polarized antenna shown in FIG. 16.

Specifically, as shown in FIG. 17A, when the switching element 390 connected between the input/output terminal 110 and the input/output terminal 310 is on (displayed by solid lines), the switching element 390 connected between the input/output terminal 110 and the input/output terminal 410 is off (displayed by broken lines). Similarly, when the switching element 390 connected between the input/output terminal 210 and the input/output terminal 410 is on, the switching element 390 connected between the input/output terminal 210 and the input/output terminal 310 is off.

In this case, the multi-frequency circularly polarized antenna 300 emits circularly polarized waves with dextrorotatory polarization the same as in the above-described second preferred embodiment.

Figure 17B:
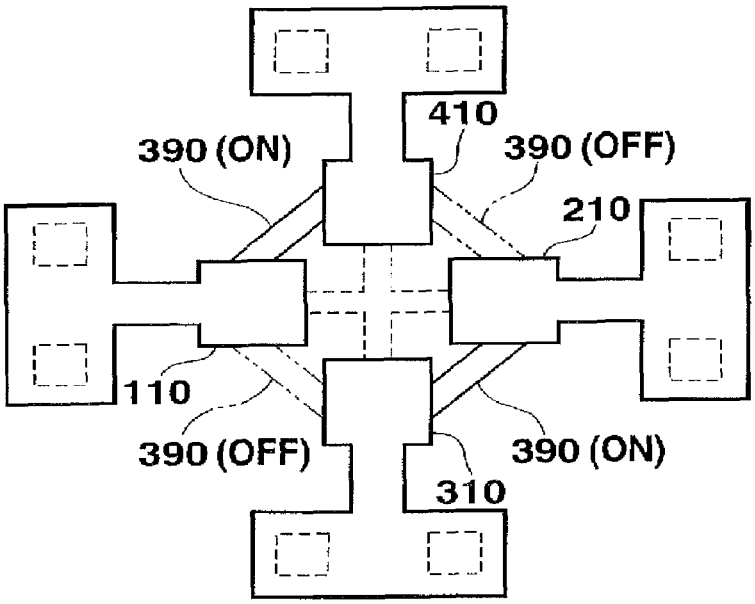
FIG. 17B is an enlarged view of an input/output terminal portion of the multi-frequency circularly polarized antenna shown in FIG. 16.

In contrast, as shown in FIG. 17B, when the switching element 390 connected between the input/output terminal 110 and the input/output terminal 410 is on, the switching element 390 connected between the input/output terminal 110 and the input/output terminal 310 is off. Similarly, when the switching element 390 connected between the input/output terminal 210 and the input/output terminal 310 is on, the switching element 390 connected between the input/output terminal 210 and the input/output terminal 410 is off.

In this case, the multi-frequency circularly polarized antenna 300 emits circularly polarized waves with levorotatory polarization.

With this composition, the multi-frequency circularly polarized antenna 300 can switch the rotation direction of the circularly polarized waves by the switching elements 390 being on or off.

Consequently, the multi-frequency circularly polarized antenna 300 becomes a circularly polarized antenna capable of both left and right rotation directions, thereby being usable without being limited by geographical area and/or the like.

(Variation)

The present invention is not limited to the above-described first through third preferred embodiments, for various variations and applications are possible.

For example, in the above-described first through third preferred embodiments, the pattern positioned on one main surface of the substrate 99 and the pattern positioned on the other main surface are connected by vias. However, these may be connected by capacitance bonds or inductive bonds rather than vias.

In addition, in the above-described first through third preferred embodiments, the inductors and conductors and/or the like comprise lines (circuit patterns), but for example it would be fine for some or all of the inductors and conductors and/or the like to comprise chip components and/or the like.

In addition, in the above-described first through third preferred embodiments, the circuits were positioned on one of the main surfaces of the substrate and the other main surface, but these may be positioned on only one main surface.

In addition, in the above-described first through third preferred embodiments, an exemplary composition was disclosed in which the circuit elements are arranged on a dielectric substrate, but a substrate need not be disposed so long as the various circuit elements can be maintained This application claims the benefit of Japanese Patent Application 2010-193530, filed 31 Aug. 2010, the entire disclosure of which is incorporated by reference herein.

INDUSTRIAL APPLICABILITY

The antenna of the present invention can be used in the industrial field of wireless communications.

DESCRIPTION OF REFERENCE NUMERALS

100, 200, 300 Multi-frequency circularly polarized antenna
101, 102, 103, 104, 900, 901 Multi-frequency antenna
99 Substrate
110, 210, 310, 410, 190, 290 Input/output elements
120, 220, 320, 420 Antenna elements
130, 150*a*, 150*b*, 230, 250*a*, 250*b*, 330, 350*a*, 350*b*, 430, 450*a*, 450*b* Vias
150, 250, 350, 450 Via conductors
140, 240, 340, 440 Series-inductor conductors
160*a*, 160*b*, 260*a*, 260*b*, 360*a*, 360*b*, 460*a*, 460*b* Series-capacitor conductors
170, 270, 370, 470 Shunt-inductor conductors
198, 398 Connection points
199 Center point
390 Switching elements
50 Amplifiers

The invention claimed is:

1. An antenna comprising first and second multi-frequency antennas, each comprising:

a first antenna with multiple resonant frequencies, comprising a first input/output terminal, a first antenna conductor, a series circuit of a first inductor and a first capacitor connecting the first input/output terminal and the first antenna conductor, and a second inductor one end of which is connected to the first antenna conductor;

a second antenna with multiple resonant frequencies, comprising a second input/output terminal, a second antenna conductor, a series circuit of a third inductor and a second capacitor connecting the second input/output terminal and the second antenna conductor, and a fourth inductor one end of which is connected to the second antenna conductor and the other end of which is connected to the other end of the second inductor; and wherein the first antenna and the second antenna are positioned substantially mirror-image symmetrically;

wherein the first multi-frequency antenna and the second multi-frequency antenna are positioned so as to intersect substantially orthogonally at a center point, and the other end of the fourth inductor of the first multi-frequency antenna is further connected to the other end of the fourth inductor of the second multi-frequency antenna.

2. The antenna according to claim 1, wherein the multiple resonant frequencies of the first antenna and the multiple resonant frequencies of the second antenna are substantially the same.

3. The antenna according to claim 1, further comprising a dielectric board;

wherein the first and second input/output terminals and the first and second antenna conductors are formed on one surface of the dielectric board;

the second and fourth inductors are disposed on the other surface of the dielectric board, and through a via one end of the second inductor is connected to the first antenna conductor and one end of the fourth inductor is connected to the second antenna conductor;

the first capacitor comprises a portion of the first antenna conductor, a first conductor disposed on the other surface of the dielectric board and opposing the portion of the first antenna conductor, and the dielectric board positioned between the portion of the first antenna conductor and the first conductor;

the second capacitor comprises a portion of the second antenna conductor, a second conductor disposed on the other surface of the dielectric board and opposing the portion of the second antenna conductor, and the dielectric board positioned between the portion of the second antenna conductor and the second conductor;

the first inductor is disposed on one surface of the dielectric board, one end of the first inductor is connected to the first conductor through a via and the other end of the first inductor is connected to the first input/output terminal; and the third inductor is disposed on one surface of the dielectric board, one end of the third inductor is connected to the second conductor through a via and the other end of the third inductor is connected to the second input/output terminal.

4. The antenna according to claim 1, further comprising:

a first signal source one end of which is connected to the first input/output terminal of the first multi-frequency antenna and the other end of which is connected to the second input/output terminal of the first multi-frequency antenna; and a second signal source one end of which is connected to the first input/output terminal of the second multi-frequency antenna and the other end of which is connected to the second input/output terminal of the second multi-frequency antenna;

wherein the signal generated by the first signal source and the signal generated by the second signal source have the same amplitude and have a phase difference of $\pm\pi/2$.

5. The antenna according to claim 1 wherein:

the first input/output terminal of the first multi-frequency antenna and the first input/output terminal of the second multi-frequency antenna are connected and form one input/output terminal, and the second input/output terminal of the first multi-frequency antenna and the second input/output terminal of the second multi-frequency antenna are connected and form one input/output terminal;

the antenna further comprises a signal source one end of which is connected to the first input/output terminal of the first multi-frequency antenna and the other end of which is connected to the second input/output terminal of the second multi-frequency antenna; and the inductance of the first through fourth inductors and the capacitance of the first and second capacitors are adjusted so that radio waves emitted from the first multi-frequency antenna and radio waves emitted from the second multi-frequency antenna have the same amplitude and the phase difference becomes $\pm\pi/2$.

6. The antenna according to claim 1, further comprising:

a first switching element one end of which is connected to the first input/output terminal of the first multi-frequency antenna and the other end of which is connected to the first input/output terminal of the second multi-frequency antenna;

a second switching element one end of which is connected to the first input/output terminal of the first multi-frequency antenna and the other end of which is connected to the second input/output terminal of the second multi-frequency antenna;

a third switching element one end of which is connected to the second input/output terminal of the first multi-frequency antenna and the other end of which is connected to the first input/output terminal of the second multi-frequency antenna;

a fourth switching element one end of which is connected to the second input/output terminal of the first multi-frequency antenna and the other end of which is connected to the second input/output terminal of the second multi-frequency antenna; and a signal source one end of which is connected to the first input/output terminal of the first multi-frequency antenna and the other end of which is connected to the second input/output terminal of the first multi-frequency antenna;

wherein when the first and fourth switching elements are on, the second and third switching elements are off, and when the first and fourth switching elements are off, the second and third switching elements are on; and the inductance of the first through fourth inductors and the capacitance of the first and second capacitors are adjusted so that radio waves emitted from the first multi-frequency antenna and radio waves emitted from the second multi-frequency antenna have the same amplitude and the phase difference becomes $\pm\pi/2$.

* * * * *

UNITED STATES PATENT AND TRADEMARK OFFICE

CERTIFICATE OF CORRECTION

PATENT NO. : 9,093,757 B2
APPLICATION NO. : 13/819711
DATED : July 28, 2015
INVENTOR(S) : Yutaka Aoki et al.

It is certified that error appears in the above-identified patent and that said Letters Patent is hereby corrected as shown below:

On the Title Page, below item (65) Prior Publication Data, insert --(30) Foreign Application Priority Data Aug. 31, 2010 (JP).....2010-193530--.

On the Title Page, item (57) Abstract, line 8, delete "(1q0," and insert --(110,--.

Signed and Sealed this
Twenty-fourth Day of May, 2016

Michelle K. Lee

Michelle K. Lee
*Director of the United States Patent and Trademark Office*